US006209436B1

(12) United States Patent
Smithwick

(10) Patent No.: US 6,209,436 B1
(45) Date of Patent: Apr. 3, 2001

(54) CUTTING DIE FOR CUTTING CORRUGATED BOARD HAVING A QUICK ATTACH/DETACH BLADE SECURING MECHANISM

(75) Inventor: James M. Smithwick, Holly Springs, NC (US)

(73) Assignee: Container Graphics Corporation, Cary, NC (US)

( * ) Notice: Subject to any disclaimer, the term of this patent is extended or adjusted under 35 U.S.C. 154(b) by 0 days.

(21) Appl. No.: 09/016,991

(22) Filed: Mar. 2, 1998

(51) Int. Cl.[7] ..... B26D 7/26; B26F 1/46

(52) U.S. Cl. ..... 83/699.11; 83/698.11; 83/698.71

(58) Field of Search ..... 83/698.11, 698.71, 83/698.31, 699.11, 532, 654, 655, 698.41; 76/107.8

(56) References Cited

U.S. PATENT DOCUMENTS 969,371 * 9/1910 Helm ..... 83/69.11 X
3,941,038 * 3/1976 Bishop ..... 83/698.71 X
5,029,505 * 7/1991 Holliday ..... 83/699.11 X
5,275,076 * 1/1994 Greenwalt ..... 83/698.71 X
5,890,410 * 4/1999 Hinojosa ..... 83/699.11 X

FOREIGN PATENT DOCUMENTS

000690835 * 7/1964 (CA) ..... 83/698.91

* cited by examiner

*Primary Examiner*—Rinaldi I. Rada
*Assistant Examiner*—Boyer Ashley
(74) *Attorney, Agent, or Firm*—Coats & Bennett, PLLC

(57) ABSTRACT

A cutting die for cutting corrugated board that includes a quick attach and detach securing mechanism. The blade securing mechanism allows a blade to be quickly and easily removed from a die board that forms a part of the cutting die, and allows a replacement blade to be quickly and easily inserted into the die board. The die board includes a first slit for receiving a blade and a second slit adjacent the first slit. The blade securing mechanism is associated with the second slit for spreading the second slit and effectively closing the first slit against the blade so as to secure the blade within the first slit.

18 Claims, 7 Drawing Sheets

CUTTING DIE FOR CUTTING CORRUGATED BOARD HAVING A QUICK ATTACH/DETACH BLADE SECURING MECHANISM

FIELD OF THE INVENTION

The present invention relates to a cutting die for cutting corrugated board and other materials, and more particularly to a cutting die having a quick attach/detach mechanism for securing blades and rules to a die board that forms a part of the cutting die.

BACKGROUND OF THE INVENTION

In manufacturing corrugated board containers, sheets of corrugated board (blanks) are fed into a die cutting apparatus which typically trims, creases and cuts the corrugated board blank to form a corrugated board product that typically assumes a sheet form but which can be readily folded and shaped into a corrugated board container. Various types of die cutting assemblies are conventionally used. Basically, however, there are two types of die cutting assemblies—a rotary die type and a flat die type. In either case, the die assembly includes a die board. The die board is designed to perform a variety of functions on the corrugated board blanks. Typically, the die board is provided with cutting blades, scoring rules, and rubber scrap and product ejectors.

Cutting blades and scoring rules, which are collectively referred to herein as blades, are typically permanently or at least semi-permanently mounted in the die board. This, of course, means that they are not easily removed from the die board. Generally, in manufacturing die boards, a slit or groove is cut within the die board to conform with a blade or knife pattern design. The width of the slit or groove is specifically cut such that a strong frictional fit is achieved after the blade is pressed into the slit. In any event, the fit is sufficiently tight that the blade remains stationary or stable even through repeated and long die cutting operations.

For the most part, blades are not generally removed from die boards. If they are removed, the task becomes tedious, time-consuming and in the end very difficult and even costly. Because of this, blade adjustment or replacement is not routine. Most corrugated container manufacturers, when faced with blade replacement, will ship the cutting die back to the die maker for blade replacement.

However, there has been and continues to be a need for a die board that enables operators to quickly and easily exchange blades or adjust the position of existing blades within the die board. For example, one situation that comes to mind deals with the problem of forming nicks in blades. Nicks are small indentions made in the tip of blades for the express purpose of preventing the blade in the area of the nick from making a complete cut through the corrugated board blank. Thus, by appropriately nicking a blade, the operator can provide a very thin attachment between two adjacent corrugated panels, for example. This is a common practice in the corrugated board industry as nicks are widely used in certain situations to maintain a very thin and easily breakable connection between two panels of corrugated board.

Nick blades are provided in a variety of ways. Unfortunately, and all too often, die operators form nicks on existing blades with tools, such as a screw driver and hammer, while the blade is held within the die board. Such nicks are far from precise and the corrugated board product cut by such nick blades will reflect such. Moreover, once formed, these nicks are difficult to adjust, if adjustment can be made at all. From time to time, because of the nature of these die cutting assemblies, adjustments will have to be made. To replace or make such adjustments die operators may attempt to remove the nick blade or blades from the die board. But as pointed out above, this is a time-consuming and expensive procedure because to do so requires that the die cutting apparatus be shut down. Furthermore, the average die operator does not necessarily possess the skill or the training to efficiently remove and reinsert blades of any type within the die board.

SUMMARY AND OBJECTS OF THE INVENTION

The present invention presents a cutting die for cutting corrugated board that includes a quick attach/detach blade securing mechanism. By actuating the blade securing mechanism, a blade can be quickly and easily removed from a die board that forms a part of the cutting die, and a replacement blade can likewise be quickly and easily inserted into the die board.

In one embodiment of the present invention, a method is disclosed for securing a blade in the die board by forming a first slit or groove in the die board for receiving a blade. A second slit or groove is formed in the die board adjacent the first slit that retains the blade. The slit for retaining the blade is effectively open and closed by spreading and releasing the second slit. By spreading the second slit, a portion of the die board extending between the two slits is effectively pushed or urged towards the first slit. This results in the first slit effectively closing about the blade and securely locking the blade in place. To remove the blade, the second slit is relaxed or returned to its normal unspreaded state, resulting in the first slit assuming an open or unlocked mode.

In this embodiment, there is provided a bore formed in the die board adjacent the second slit. Disposed within the bore is a rotary cam lock that is rotatable between locked and unlocked positions. To lock the blade within the first slit, the rotary cam lock is rotated such that a cammed surface of the lock is turned into engagement with one side of the second slit, causing the slit to be spreaded and in the process resulting in the first slit being closed about the blade therein. By rotating the cam lock from the locked position to the unlocked position results in the second slit assuming a relaxed or unspreaded state. This effectively opens or releases the first slit enabling the blade therein to be easily removed therefrom.

In another embodiment of the present invention, an insert is secured within the second slit. The insert includes a bearing strip against which the rotary cam lock engages when the same assumes a locked position. That is, the insert includes a bearing strip that extends through the second slit and is disposed adjacent the rotary cam lock. Projecting from the bearing strip is at least one retaining tab that is aligned with the adjacent bore and functions to assist in retaining the rotary cam lock within the bore.

In yet another embodiment, the present invention entails a die board having a bore formed in the die board adjacent a slit that retains a blade therein. The bore is opened or exposed to the slit and the blade. Disposed within the bore is a rotary locking device that is rotatable between a locked and unlocked position. In the locked position, the rotary lock engages a side portion of the blade and presses the blade into engagement with one side of the slit that retains the blade. Thus the blade is effectively wedged or locked between the rotary locking device and one side of the slit that retains the blade.

It is therefore an object of the present invention to provide a die board for cutting corrugated board with a quick attach/detach mechanism for securing blades within the die board.

A further object of the present invention is to provide a die board of the character referred to above that will enable die operators to quickly and easily exchange or adjust blades within the die board.

Still a further object of the present invention is to provide a quick attach/detach blade securing mechanism for a die board that can be actuated without disturbing adjacent scrap or product ejector rubber.

Other objects and advantages of the present invention will become apparent and obvious from a study of the following description and the accompanying drawings which arc merely illustrative of such invention.

DETAILED DESCRIPTION OF THE INVENTION

With further reference to the drawings, a cutting die of the type utilized in die assemblies for cutting corrugated board and other paper materials is shown therein and indicated generally by the numeral 10. It should be noted that the cutting die 10 of the present invention is intended to be primarily used to cut corrugated board and other paper materials. However, the cutting die 10 can be used to cut other materials. Cutting die 10 includes a die board 11 having an upper surface 12 and in the embodiment illustrated is constructed of laminated plywood. It should be appreciated that the die board 11 could be constructed of other suitable materials and could be flat or cylindrical and, accordingly, could be utilized within a flat die cutting assembly or a rotary die cutting assembly. Details of such die cutting assemblies and die boards are not dealt with here in detail because such is not per se material to the present invention and further, cylindrical die boards and flat die boards are known and well appreciated by those ordinarily skilled in the art. Suffice it to say that the die board 11 is of the type that is typically provided with cutting blades, creasing rules, rubber scrap ejectors, rubber product ejectors, etc.

The present invention focuses on securing cutting blades or creasing rules within the die board 11. As used herein, blade or cutting blade refers both to blades that actually cut corrugated board and to creasing rules. Thus, the term blade encompasses all types of blades or rules that might be utilized in a die board that cuts and/or creases corrugated board.

Figure 1:
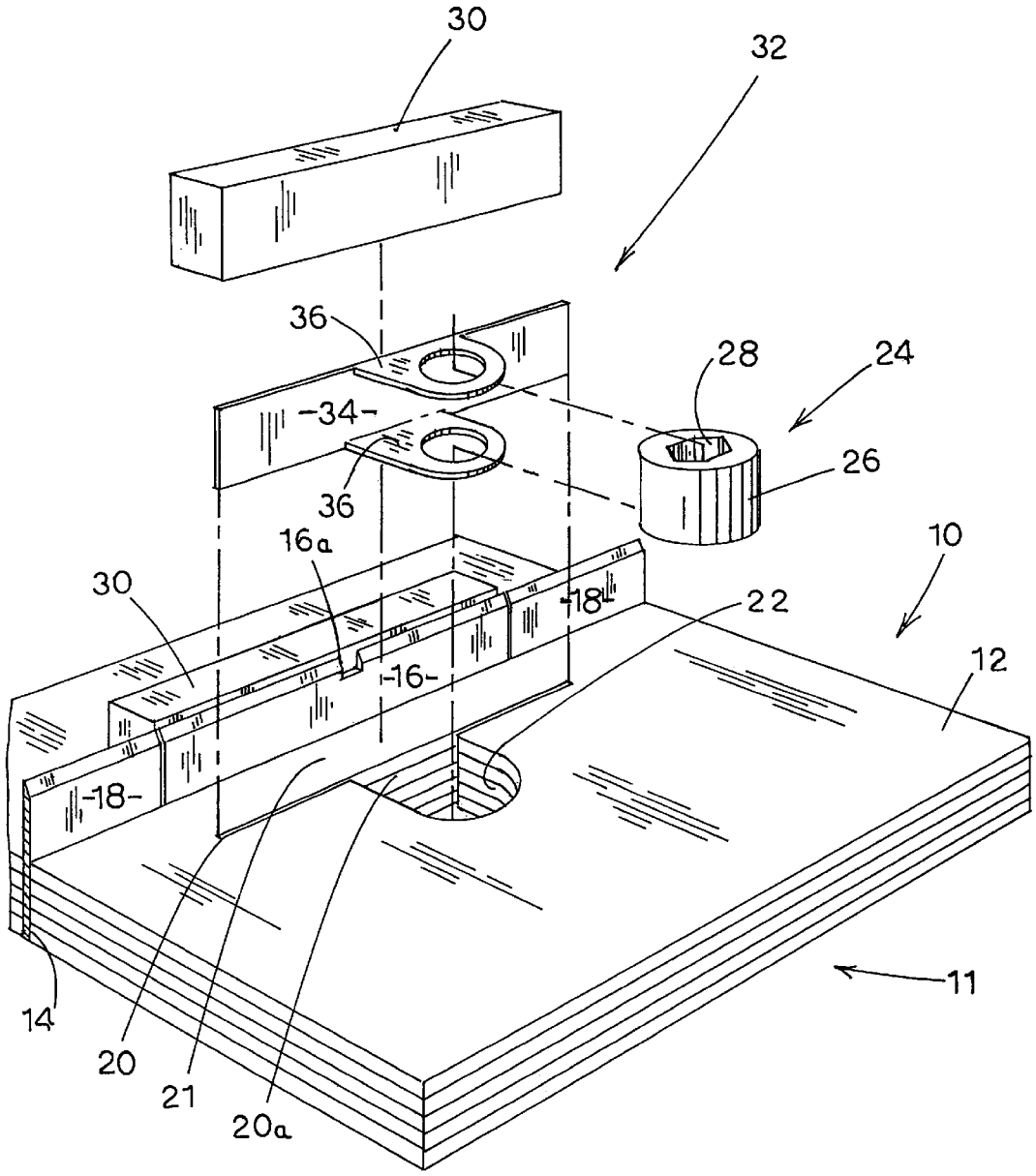
FIG. 1 is an exploded view illustrating the cutting die and the quick attach/detach blade securing mechanism of the present invention.
Figure 2:
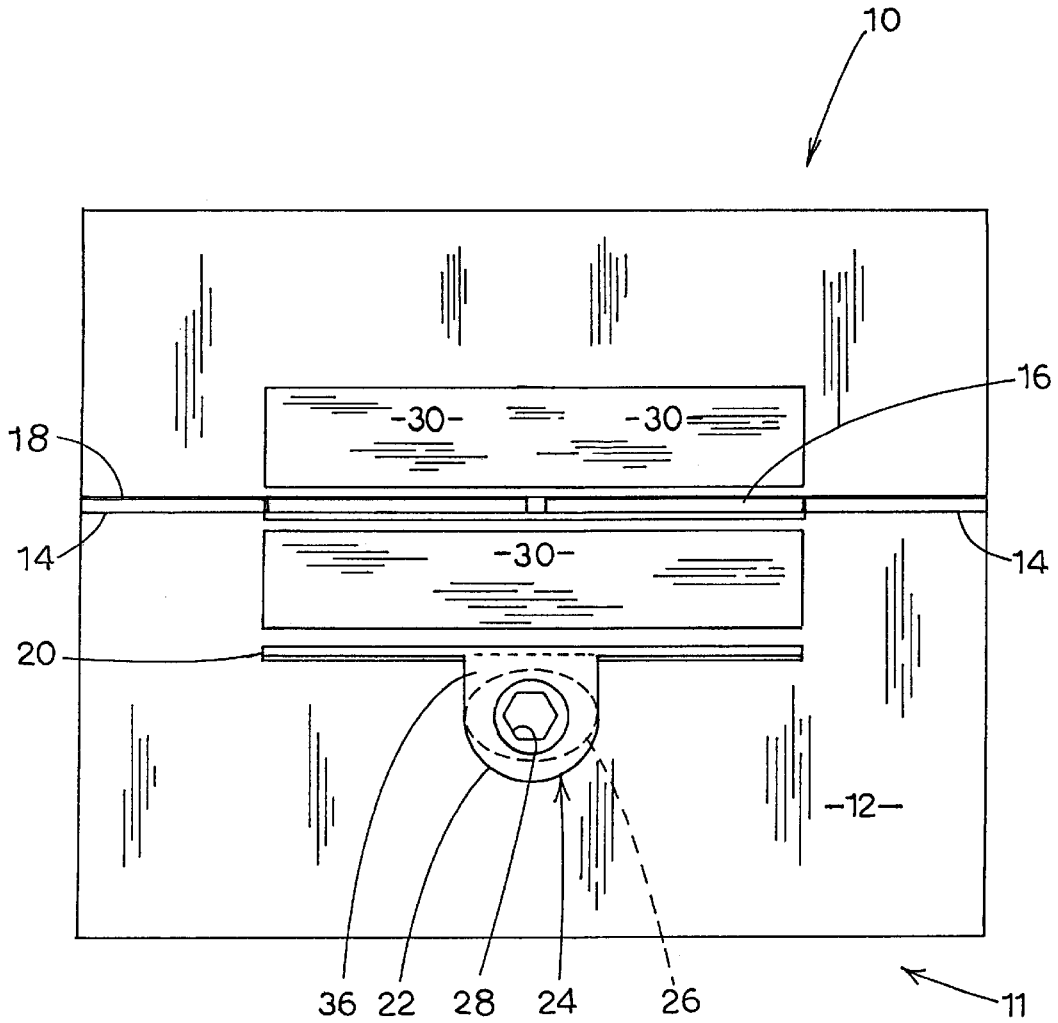
FIG. 2 is a fragmentary top plane view of a portion of the cutting die showing the quick attach/detach blade securing mechanism.
Figure 3:
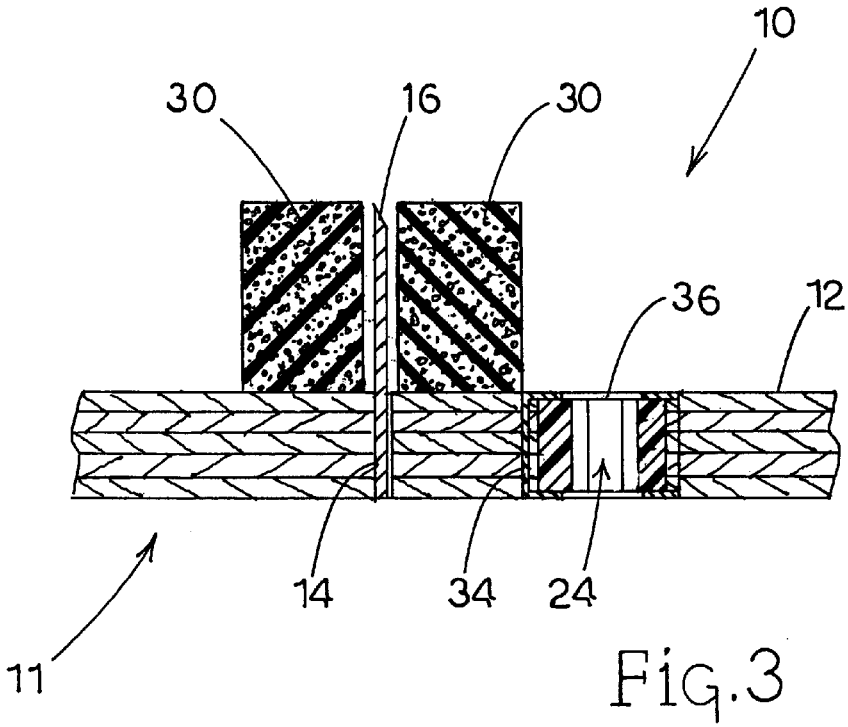
FIG. 3 is a transverse sectional view of the cutting die shown in FIG. 1 showing the quick attach/detach mechanism in an unlocked position.
Figure 4:
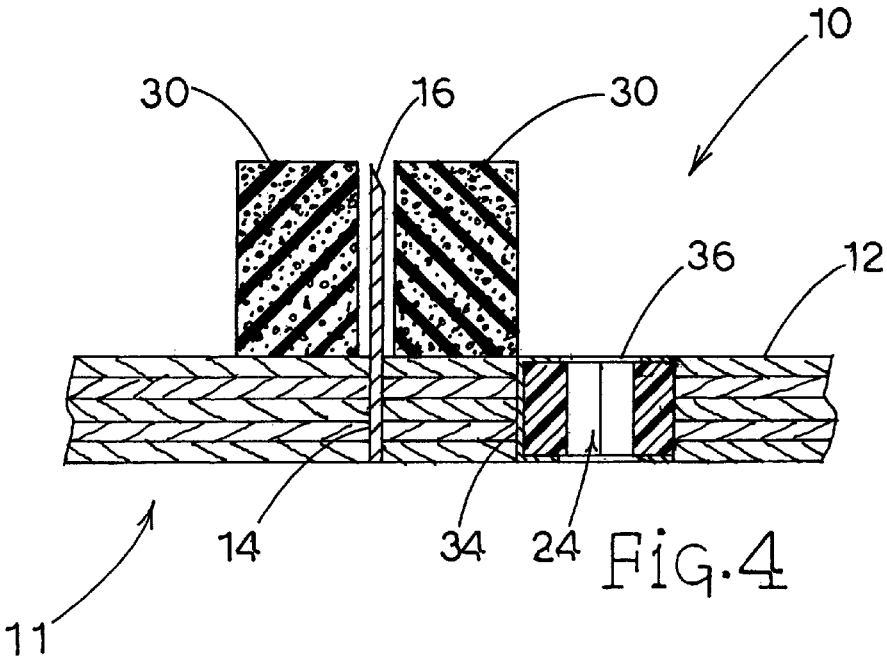
FIG. 4 is a view similar to FIG. 3 but with the quick attach/detach mechanism being shown in the locked position.

Referring to FIG. 1 in particular, the die board 11 is provided with an elongated first slit or groove 14. Slit 14 is designed to receive and hold one or more blades in end to end relationship. In the case of the embodiment illustrated herein, the first slit 14 has inserted therein a nick blade 16 having a nick 60*a* formed in the upper tip thereof and a pair of conventional blades 18 secured on opposite ends thereof.

Figure 5:
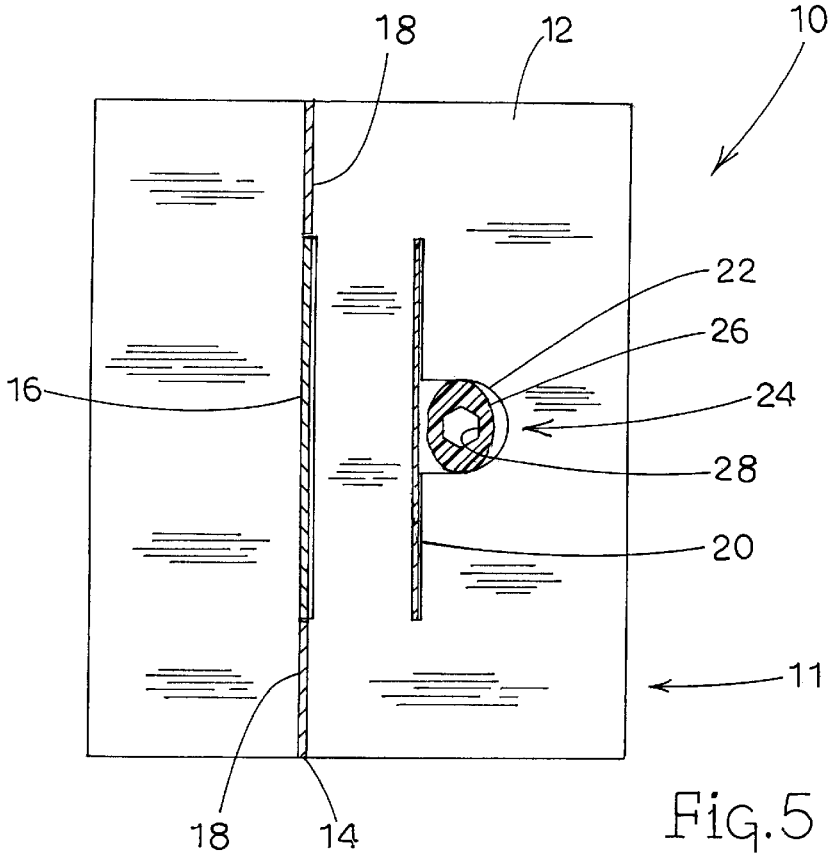
FIG. 5 is a fragmentary horizontal sectional view taken through the cutting die showing the quick attach/detach mechanism in the unlocked position.

Slit 14 along its run that receives the nick blade 16 has been selectively cut such that the nick blade 16 can be easily inserted and withdrawn from the slit. That is, the slit 14 in the area occupied by the nick blade 16 is slightly greater in width than the width of the nick blade 16. This is particularly shown in FIG. 5. Note that the slit along the run of the nick blade 16 has been effectively double-cut so that the blade is only loosely held within the slit 14 when the blade assumes an unsecured position within the slit. The width of the slit 14 in this area can vary but it is contemplated that the width of the slit 14 would be approximately 0.001–0.002 inches greater than the width of the nick blade 16. This will enable the nick blade 16 to be easily inserted within that portion of the slit 14 and will also enable the slit 14 to be closed down and locked on the nick blade, as will be more fully discussed in subsequent portions of this disclosure.

Spaced from the first slit 14, is a second slit 20 that is cut and formed in the die board 11. As seen in FIG. 1, the second slit 20 is spaced from the first slit 14 such that it extends approximately the same length as the nick blade 16 and, as such, there is defined a relatively small run 21 between the two slits 14 and 20. Slit 20 includes a pair of sides, an inner side 20*a*, as shown in FIG. 1, and an outer side that opposes the inner side 20*a*. The inner side of 20*a* refers to a side surface of the slit but as used herein, the term inner side can refer to the side portion of the die board that forms a part of the slit and can also refer to a bearing surface or strip that is disposed within the slit 20.

Formed in the die board 11 about the outer side of the second slit 20 is a bore 22. Note in FIG. 1 where the bore 22 cuts through the outer side of the second slit 20. Consequently, the bore 22 is open to the inner side 20*a* of the second slit 20. Thus, it is appreciated that the inner side 20*a* of the second slit and the bore 22 form a surrounding boundary or cavity within the die board 11.

Adapted to be disposed within the bore 22 is a rotary locking device indicated generally by the numeral 24 and particularly shown in FIG. 1. Rotary locking device 24 includes a cammed or eccentric outer surface 26 and an internal aperture 28 that forms a tool grip for turning the rotary locking device.

Figure 6:
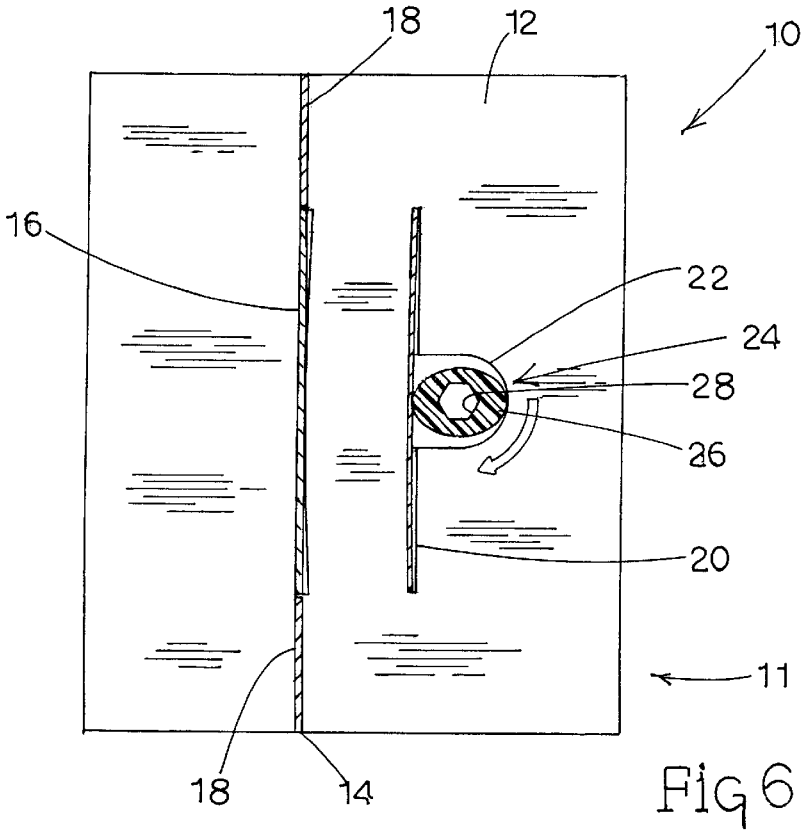
FIG. 6 is a fragmentary horizontal sectional view taken through the cutting die showing the quick attach/detach mechanism in the locked position.
Figure 7:
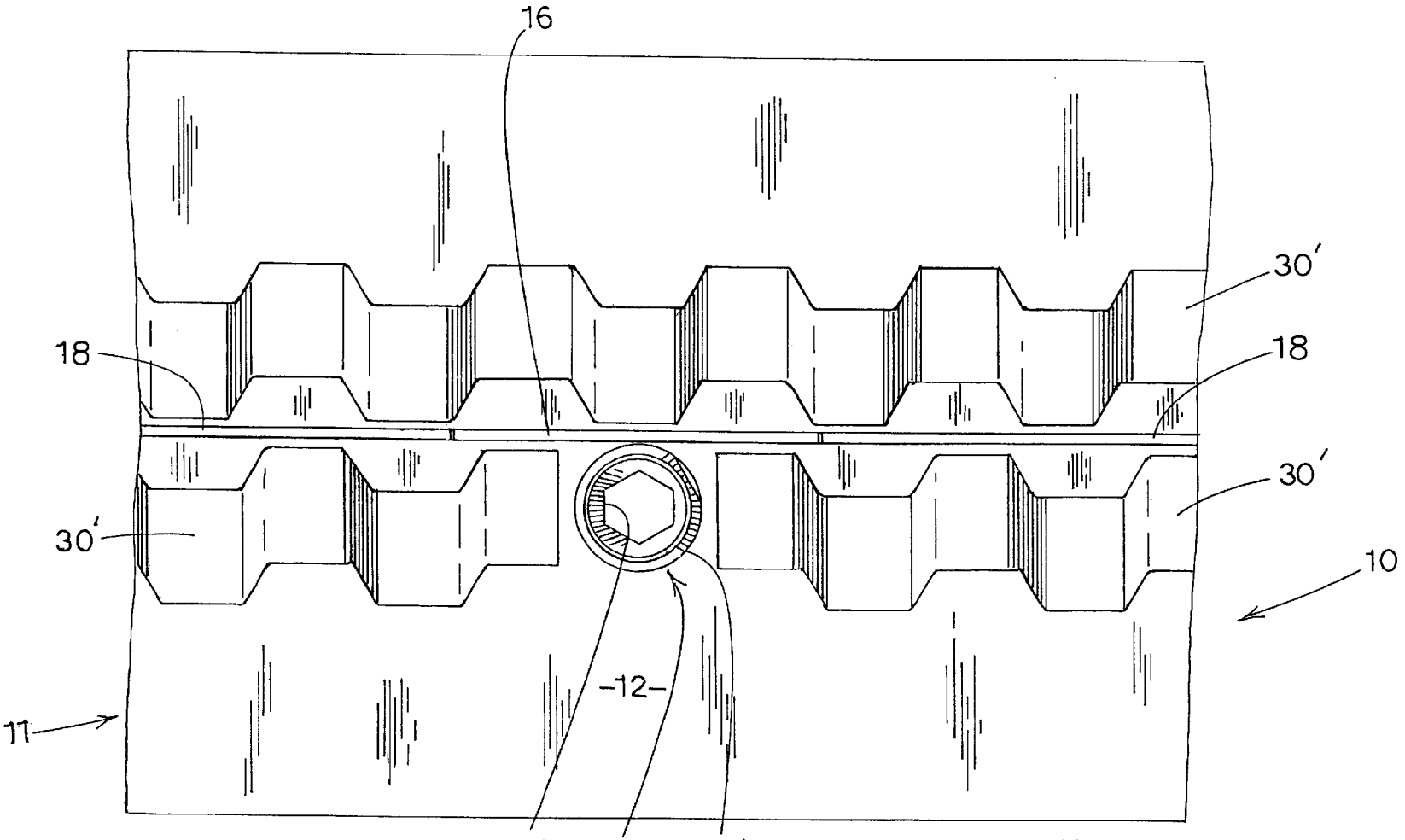
FIG. 7 is a top plane view of an alternate embodiment of the quick attach/detach mechanism of the present invention.
Figure 8:
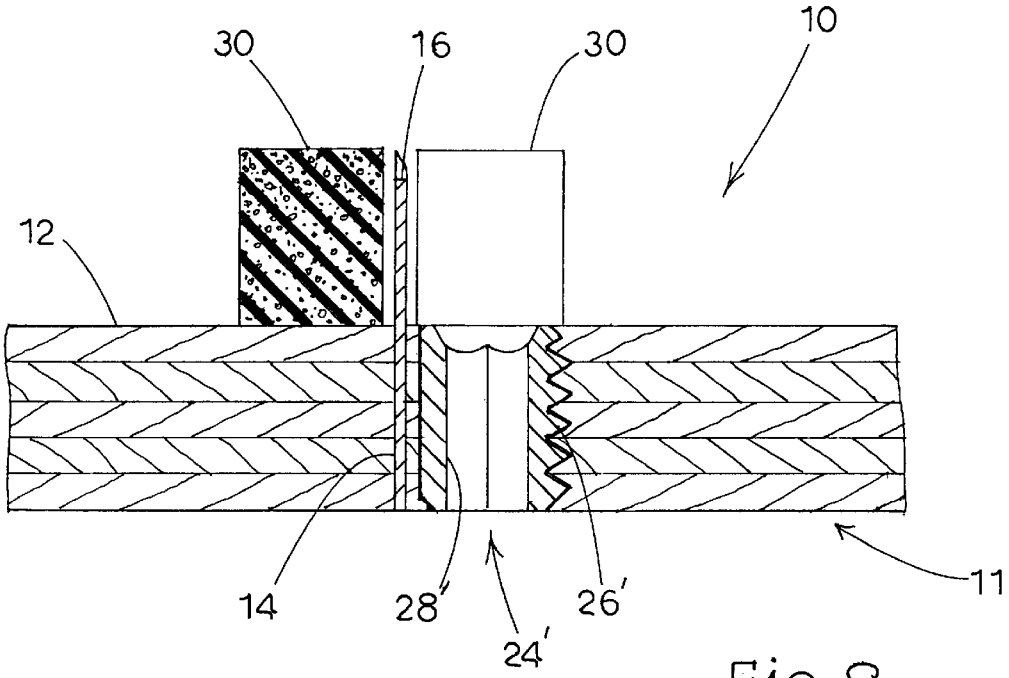
FIG. 8 is a transverse sectional view of a portion of the cutting die shown in FIG. 7 showing the quick attach/detach mechanism in an unlocked position.
Figure 9:
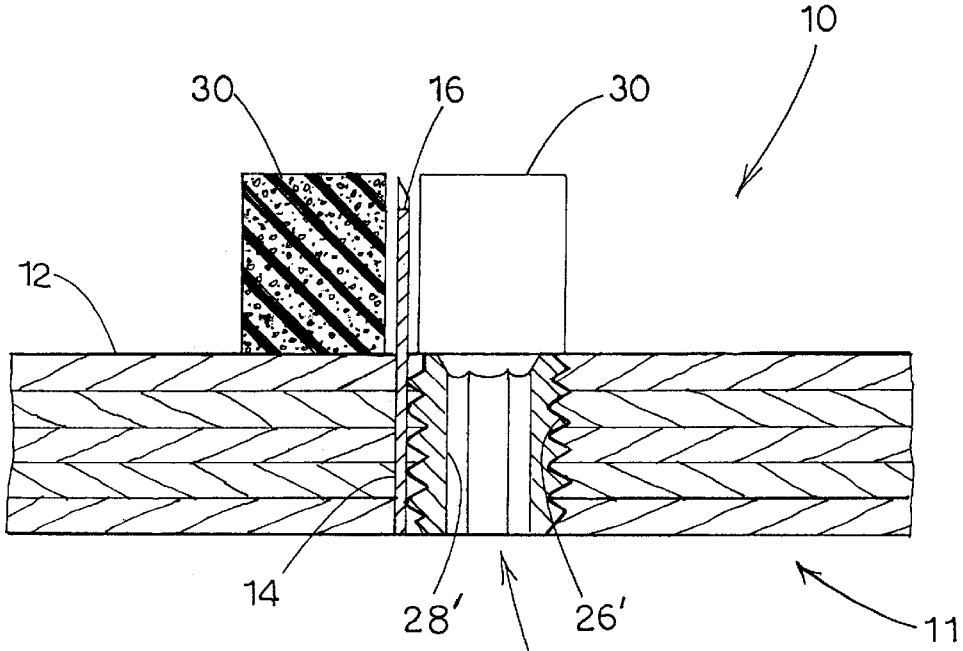
FIG. 9 is a transverse sectional view similar to FIG. 8 but with the quick attach/detach mechanism being disposed in a locked position.

Rotary locking device 24 is designed to be inserted within the bore 22 and to move between locked and unlocked positions. In particular, the cammed or eccentric outer surface 26 of the rotary locking device 24 is designed such that when it assumes the locked position, it causes the second slit 20 to spread and in the process of the second slit spreading, the first slit 14, along the length of the nick blade 16, will be closed, effectively clamping the slit 14 against the nick blade 16. See FIG. 6. Effectively, once the rotary locking device 24 is turned to a locked position so as to slightly open or spread the second slit 20, it follows that the run or die board portion 21 that lies between the first slit 14 and the second slit 20 tends to be moved or urged toward slit 14 and the nick blade 16 retained therein. Consequently, as pointed out above, this slight movement of the run or die board portion 21 towards the first slit 14 acts to clamp and secure the nick blade 16 within the first slit 14.

In the embodiment illustrated in FIGS. 1–6, the rotary locking device 24 is simply designed to be retained within the bore 22 and is not threaded. However, it will be appreciated by those skilled in the art that the locking device 24 could indeed be threaded and retained within the bore 22 by such means.

Although the rotary locking device 24 can be employed within the die board 11 so as to directly engage the inner surface 20*a,* it is contemplated that a preferred design would entail a bearing strip against which the rotary locking device 24 would engage. In this regard, as shown in FIG. 1, there is provided an insert, indicated generally by the numeral 32 that is designed to be inserted or pressed into the second slit 20. Insert 32 includes an elongated bearing strip 34 and a pair of aligned tabs 36 that project outwardly from the bearing strip 34. Tabs 36 include a pair of aligned openings and are designed to basically align with the bore 22 formed in the die board 11. Insert 32 could be constructed of various materials such as metal or plastic or other suitable materials.

Prior to inserting the insert 32 into the slit 20, the rotary locking device 24 is inserted between the tabs 36 such that the aperture 28 formed in the locking device generally aligns with the openings in the tabs. Once the locking device 24 has been inserted between the tabs 36, the insert 32 is pressed downwardly into the second slit 20, as illustrated in FIG. 1. In the case of the embodiment illustrated in FIGS. 1–6, the bore 22 extends completely through the die board 11. Therefore, the tabs 36 serve as a pair of spaced apart retainers for the locking device 24 while permitting access to the rotary locking device from either the top or bottom of the die board 11.

Thus when the insert 32 is securely set within the die board 11, it is seen that the rotary locking device 24 is designed to engage the bearing strip 34, as the bearing strip essentially acts as the inner side of the second slit 20. When the rotary locking device 24 assumes an unlocked position or mode (FIGS. 3 and 5), the cam or eccentric surface 26 is turned or disposed away from the bearing strip 34. In this position, the first slit 14 assumes an open and unlocked position around the nick blade 16. Consequently, the nick blade 16 can be easily removed or inserted within the first slit 14. By turning or rotating the rotary locking device 24 into the locked position (See FIGS. 4 and 6), the cammed or eccentric outer surface 26 is caused to be turned into engagement with the bearing strip 34. By securely turning and locking the locking device 24, the pressure or force exerted by the device causes the second slit 20 to spread. By spreading the second slit, it follows that the die board portion 21 extending between the slits 14 and 20 is caused to be at least slightly urged or moved towards the slit 14 and the blade 16 therein. In fact, the spreading of the second slit 20 effectively causes the first slit to close and lock down on the blade 16.

In order to remove blade 16, the rotary locking device 24 can be turned from the locked position to the unlocked position. This effectively allows the second slit to return to its normal relaxed or unspreaded position and this results in the first slit 14 being opened or released about the blade 16. Thereafter, the blade 16 can be easily removed from the first slit 14.

As illustrated in FIGS. 1–4, the die board 11 is typically provided with a series of rubber ejectors 30 that are disposed adjacent the cutting blades secured within the die board. As those skilled in the art will appreciate, such rubber ejectors are used to strip or eject scrap or corrugated board product from the blades during a die cutting operation. In the case of the embodiment shown in FIGS. 1–6, it is seen that the rotary locking device 24 is spaced outwardly from the location of the rubber strippers or ejectors 30. Thus, the rotary locking device 24 can be accessed without having to pull any rubber strippers or ejectors from the die board 11.

Also, in the embodiment illustrated in FIGS. 1–6, the present invention has been discussed in the context of a rotary locking device that is useful in connection with a nick blade or a series of nick blades that may form a nick blade kit. However, it is appreciated that the quick attach/detach mechanism of the present invention could just as easily be utilized in conjunction with either cutting blades or even creasing rules.

Turning to FIGS. 7–11, an alternative embodiment of the present invention is shown therein. In the case of this alternative embodiment, the bore 22' and rotary locking device 24' are disposed directly adjacent the first slit 14 and the blade 16 retained therein. In this case, the rotary locking device 24' includes external threads that enable the locking device to be threaded into the bore 22' formed in the die board 11. However, the external surface of the rotary lock 24' still includes a cam or eccentric portion 26'.

Figure 10:
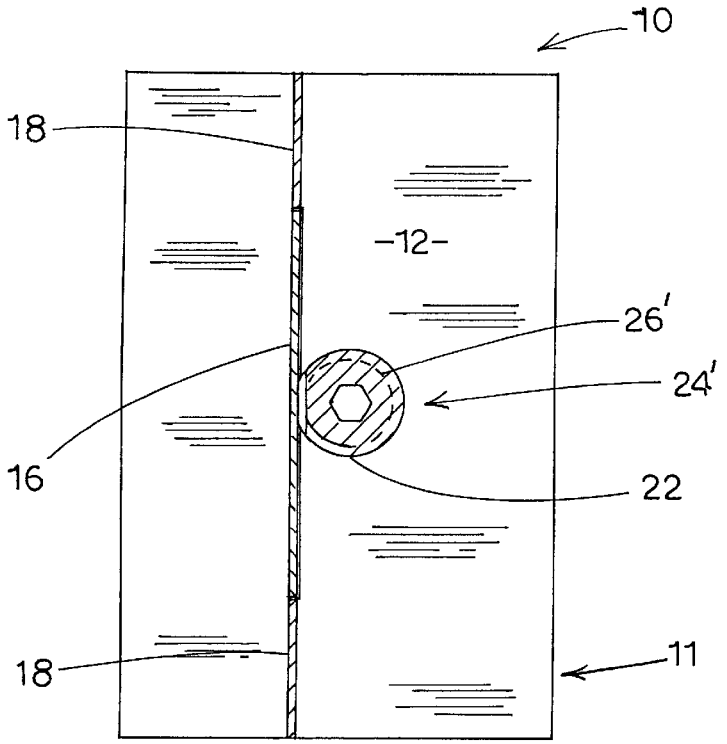
FIG. 10 is a fragmentary horizontal sectional view taken through the cutting die of FIGS. 8 and 9 showing the quick attach/detach mechanism in the unlocked position.
Figure 11:
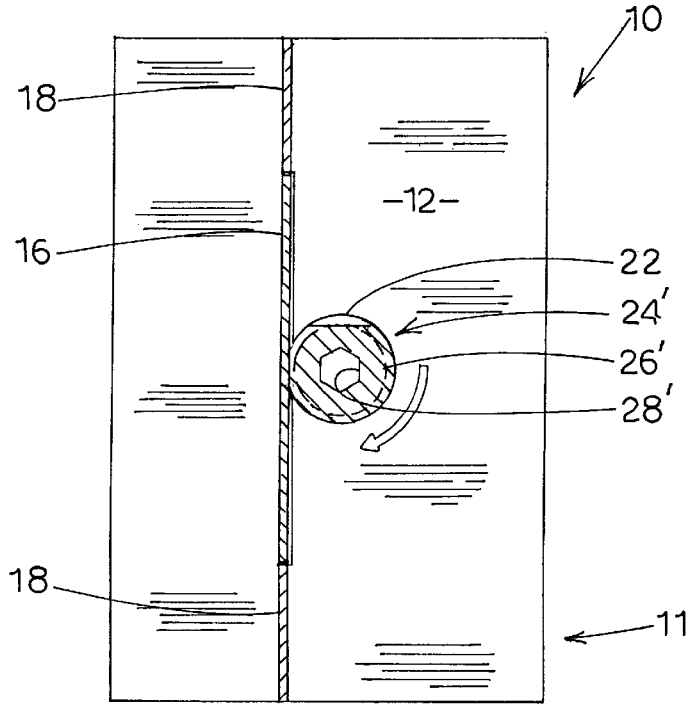
FIG. 11 is a fragmentary sectional view similar to FIG. 10 but with a quick attach/detach mechanism being disposed in a locked position.

As illustrated in FIGS. 10 and 11, the bore 22' is open directly to the side of blade 16. This, of course, means that bore 22' is cut through the adjacent side of the slit 14 such that the locking device 24' is open directly to the side of blade 16. Thus, when the rotary locking device 24' is turned to its locked position (FIG. 11), the cammed or eccentric outer surface of 26' actually engages and wedges against the exposed outer side of the blade 16. This, in effect, locks the blade 16 in place. By turning the rotary locking device 24' towards its unlocked position, the cammed outer surface thereof becomes disengaged with the blade 16 and accordingly, the blade can be easily removed from the slit 14.

From the foregoing specification and discussion, it follows that the present invention presents an efficient and effective mechanism for detachably securing a blade within a die board of the type that is designed to cut and operate on corrugated board blanks. In the case of the first embodiment shown in FIGS. 1–6, the blade 16 can be locked and released without having to remove the ejector rubber 30 disposed on either side of the blade. In addition, it should be pointed out again that the locking device disclosed herein is adapted and designed to lock and secure any type of blade within a die board of the type employed by die cutting assemblies that is utilized to cut and form corrugated board.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A cutting die having a quick attach and detach mechanism for securing a blade therein, comprising:

(a) a die board;

(b) a first slit in the die board for receiving a blade;

(c) a second slit formed in the die board adjacent the first slit, wherein an intervening die board material extends between the first and second slits; and (d) a blade locking device associated with the second slit for spreading the second slit and effectively closing the first slit against the blade so as to secure the blade within the first slit, said blade locking device having sufficient strength to at least slightly flex the intervening die board material.

2. The cutting die of claim 1 including an insert having a bearing strip disposed within the second slit and wherein the locking device moves between a locked and unlocked position and in the locked position, the locking device engages the bearing strip of the insert.

3. The cutting die of claim 1 wherein the locking device includes a rotary lock secured within a bore formed in the die board adjacent the second slit, and wherein the rotary lock is rotatable between locked and unlocked positions and wherein in the locked position, the rotary lock spreads the second slit, causing a portion of the die board extending between the first and second slits to be urged at least slightly towards the first slit and blade therein resulting in the first slit being closed on the blade.

4. The cutting die of claim 3 wherein the second slit includes an inner side and wherein the rotary lock moves into engagement with the inner side as it moves from the unlocked position to the locked position, and wherein in the locked position, the rotary lock effectively spreads the second slit and closes the first slit on the blade.

5. The cutting die of claim 4 including a bearing strip inserted within the second slit such that the bearing strip forms the inner side of the second slit and acts as a bearing surface against which the rotary lock engages when in the locked position.

6. The cutting die of claim 5 wherein the bearing strip forms a part of an insert secured within the die board, the insert including at least one retaining tab that projects from the bearing strip and is generally aligned with the bore for retaining the rotary lock within the bore.

7. The cutting die of claim 6 wherein the insert includes two spaced-apart retaining tabs that extend adjacent opposite ends of the rotary lock.

8. The cutting die of claim 1 wherein the locking device comprises a rotary cam having an outer camming surface that, when turned into a locking position, spreads the second slit.

9. The cutting die of claim 8 including a bore in the die board adjacent the second slit, and wherein the rotary cam is disposed within the bore.

10. The cutting die of claim 9 wherein the bore extends through an outer side of the second slit such that an inner side of the second slit is exposed to the bore, and wherein as the rotary cam is turned from an unlocked position to a locked position, the camming surface of the rotary cam is effective to push against the inner side of the second slit and to spread the second slit, causing the first slit to close about the blade.

11. The cutting die of claim 10 including an insert disposed within the second slit, the insert including a bearing strip against which the rotary cam engages when in the locked position.

12. A cutting die comprising:

(a) a die board;

(b) a first slit in the die board for receiving a blade;

(c) a second slit formed in the die board adjacent the first slit such that a portion of the die board extends between the first and second slits;

(d) a bore formed within the die board adjacent the second slit, the bore being open to at least one side of the second slit; and (e) a rotary lock disposed within the bore for locking the blade within the first slit, the rotary lock being movable between locked and unlocked positions and including a cammed surface that is effective to urge one side of the second slit towards the first slit which has the effect of closing the first slit about the blade, said rotary lock having sufficient strength to at least slightly flex the portion of the die board extending between the first and second slits.

13. The cutting die of claim 12 wherein the second slit includes inner and outer sides and wherein the bore is open to the inner side such that the camming surface of the rotary lock turns into engagement with the inner side as the rotary lock is turned into its locked position.

14. The cutting die of claim 12 including an insert mounted within the second slit, the insert having a bearing strip that forms an inner side of the second slit and against which the rotary lock engages when the rotary lock assumes a locked position.

15. The cutting die of claim 14 wherein the insert is constructed of metal.

16. The cutting die of claim 14 wherein the bearing strip is disposed within the second slit and includes at least one tab that projects from the bearing strip and is aligned with the bore for retaining the rotary lock in the bore.

17. A cutting die comprising:

(a) a die board;

(b) an elongated slit in the die board;

(c) a blade disposed within the elongated slit;

(d) a bore formed in the die board adjacent the slit and open to the slit and the blade;

(e) a rotary cam lock disposed within the bore and movable between locked and unlocked positions; and (f) wherein the rotary cam lock includes a camming surface that rotates into engagement with the blade as the rotary cam lock is rotated into the locked position.

18. The cutting die of claim 17 wherein the die board includes an upper surface and wherein the bore extends vertically down from the upper surface of the die board.

* * * * *